US009155930B2

(12) United States Patent
Adkins

(10) Patent No.: US 9,155,930 B2
(45) Date of Patent: Oct. 13, 2015

(54) KINETIC DUMBBELL

(71) Applicant: Daniel Adkins, Santa Fe Springs, CA (US)

(72) Inventor: Daniel Adkins, Santa Fe Springs, CA (US)

( * ) Notice: Subject to any disclaimer, the term of this patent is extended or adjusted under 35 U.S.C. 154(b) by 79 days.

(21) Appl. No.: 13/957,332

(22) Filed: Aug. 1, 2013

(65) Prior Publication Data

US 2015/0038303 A1 Feb. 5, 2015

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01)

(58) Field of Classification Search
CPC ..... A63B 21/0004; A63B 21/0608; A63B 21/072–21/075
USPC ..... 482/92–93, 106–108, 110
See application file for complete search history.

(56) References Cited

U.S. PATENT DOCUMENTS 2,676,802 A 4/1954 O'Brien
3,482,835 A * 12/1969 Dean ..... 482/108
4,756,526 A * 7/1988 Broussard ..... 482/108
6,837,833 B2 1/2005 Elledge
7,491,156 B1 * 2/2009 GaoYong ..... 482/108
7,887,469 B1 * 2/2011 Chen ..... 482/108
8,118,717 B1 * 2/2012 Lai ..... 482/108
8,317,666 B2 * 11/2012 Wang ..... 482/106
2003/0134725 A1 * 7/2003 Kim ..... 482/106
2006/0189458 A1 * 8/2006 Walkerdine ..... 482/106
2007/0249475 A1 * 10/2007 Cao ..... 482/107

* cited by examiner

*Primary Examiner* — Loan H Thanh
*Assistant Examiner* — Jennifer M Deichl
(74) *Attorney, Agent, or Firm* — Kenneth L. Green; Averill & Green

(57) ABSTRACT

A kinetic dumbbell includes offset weighted ends keyed to a single axle and a grip residing over the axle and between the weighted ends. The axle and weighted ends are free to rotate with respect to the grip. The weighted ends include slots accepting weights to adjust an offset weight of each weighted end. A timer/counter may be attached to one end to signal a user that an exercise is completed. The axle is attached to the weighted ends using a key through the axle, the key residing in channels in the weighted ends to rotationally fixing the axle to each weighted end, and screws and washers to hold the weighted ends on the axle. Bushings reside over the axle and engage each end of the handle to position the handle on the axle.

6 Claims, 5 Drawing Sheets

KINETIC DUMBBELL

BACKGROUND OF THE INVENTION

The present invention relates to dumbbell weights and in particular to an orbital dumbbell weight having weight offset from a centered handle.

Exercising with weights has become recognized as generally benefitting all ages of humans regardless of any desire for bodybuilding. Such weight training has been shown to improve muscle and bone density providing health benefits such as reducing osteoporosis with age. Unfortunately, is it often difficult to visit a gym regularly and significant space is required to set up an exercise room at home. Therefore, a need exists for compact exercise equipment that can be used at home.

One form of compact equipment is the dumbbell. Because the dumbbell is used with a single arm, significant weight is not required to obtain a benefit. However, the effect of common dumbbells is limited by the weight of the dumbbell. Kinetic dumbbells have been developed having rotating weighted ends with offset weights. When motion is used to cause the weighted ends to rotate, the rotating weight excises the user's muscles more than merely lifting the dumbbell.

U.S. Pat. No. 6,837,833 for "Specialty Weight Training Apparatus and Method" discloses such a kinetic dumbbell. While the '833 dumbbell provides the benefits of rotating offset weights, the design of '833 dumbbell includes threading the weighted ends (circular wheel-weights 30) onto an axle 20. Such threaded attachment makes it difficult to align the weighted ends.

U.S. Pat. No. 3,482,835 for "Barbell With Eccentrically Weighted Weights" discloses a kinetic dumbbell with a radially extending screw 5 bearing against a shaft 6 to allow aligning the weighted ends. Such use of a screw 5 is prone to slipping allowing the weighted end to become miss-aligned and requiring correction. Thus a need is present for a kinetic dumbbell which effectively retains the weighted ends in alignment.

BRIEF SUMMARY OF THE INVENTION

The present invention addresses the above and other needs by providing a kinetic dumbbell which includes offset weighted ends keyed to a single axle and a grip residing over the axle and between the weighted ends. The axle and weighted ends are free to rotate with respect to the grip. The weighted ends include slots accepting weights to adjust an offset weight of each weighted end. A timer/counter may be attached to one end to signal a user that an exercise is completed. The axle is attached to the weighted ends using a key through the axle, the key residing in channels in the weighted ends to rotationally fixing the axle to each weighted end, and screws and washers to hold the weighted ends on the axle. Bushings reside over the axle and engage each end of the handle to position the handle on the axle.

In accordance with one aspect of the invention, there are provided offset weighted ends having slots to accept weights. The weights are an interference fit into the slots and covered by end plates.

In accordance with another aspect of the invention, there are provided pins pressed through holes in the axle, and residing in channels in each weighted end. The channels are in interior faces of the weighted ends and prevent the weighted ends from rotating with respect to the handle, thereby fixing the respective alignment of the weighted ends.

In accordance with one still another aspect of the invention, a screw, lock washer, and flat washer are used to retain plastic weighted ends on the axle. The flat wash is selected to have sufficient strength and surface area to distribute attaching force over a sufficient area of plastic to prevent mechanical failure.

In accordance with yet another aspect of the invention, there are provided pear shaped weighted ends. The pear shape prevents the dumbbell from rolling away when dropped on a floor or after being placed on a flat surface for storage, for example, on a table or desk.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1A:
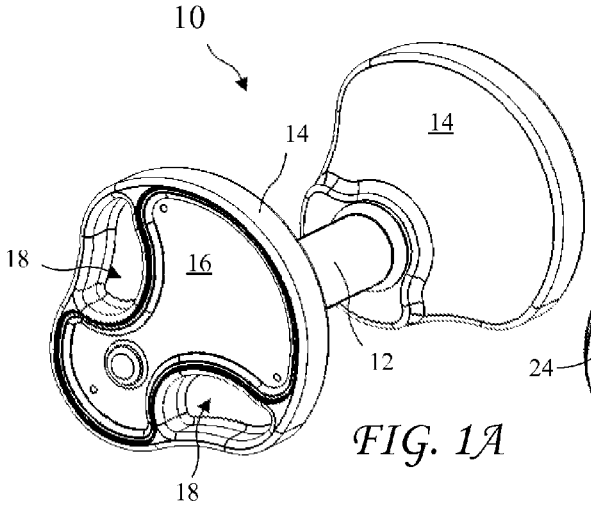
FIG. 1A is a perspective view of a kinetic dumbbell according to the present invention.
Figure 1B:
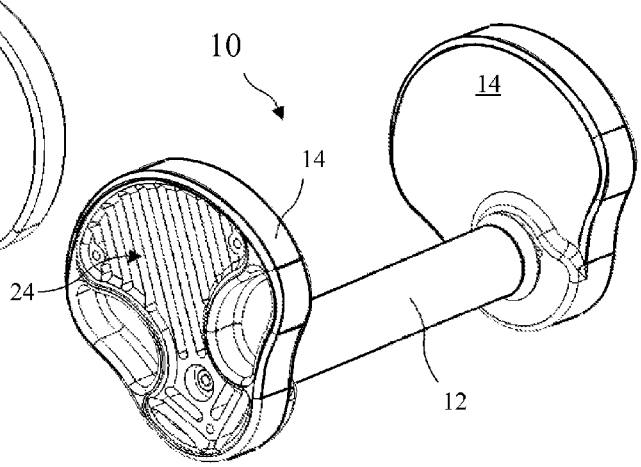
FIG. 1B is a perspective view of the kinetic dumbbell according to the present invention with a cover removed.

A perspective view of a kinetic dumbbell 10 according to the present invention is shown in FIG. 1A and perspective view of the kinetic dumbbell 10 with a cover 16 removed is shown in FIG. 1B. The kinetic dumbbell 10 includes pear shaped offset weighted ends 14 and a handle 12 between the ends 14. The cover 16 covers cavities 24 which receive weights 60 (see FIG. 9) allowing both the total weight, and the weight distribution of the kinetic dumbbell 10 to be adjusted to a user's preference. For example, weight may be added as a user gains strength or becomes more accustom to using the kinetic dumbbell 10. The weights 60 are preferably an interference fit to the pear shaped offset weighted ends 14. The covers 16 preferably press onto the pear shaped offset weighted ends 14, but may be attached using screws and the like. Two recessed areas 18 in outside faces 14*a* of each pear shaped offset weighted ends 14 allow easier grasping of the kinetic dumbbell 10.

Figure 2A:
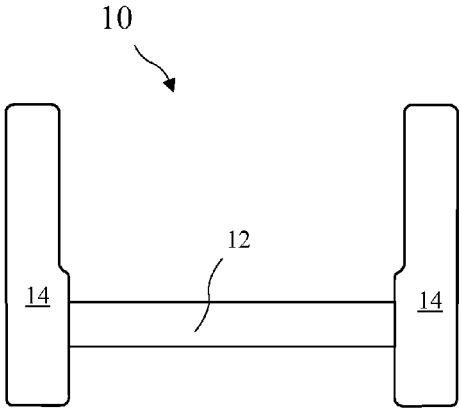
FIG. 2A is a side view of the kinetic dumbbell according to the present invention.
Figure 2B:
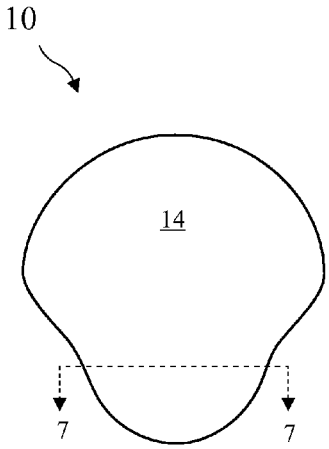
FIG. 2B is an end view of the kinetic dumbbell according to the present invention.

A side view of the kinetic dumbbell 10 is shown in FIG. 2A and is an end view of the kinetic dumbbell 10 is shown in FIG. 2B. The pear shape of the offset weighted ends 14 prevents the kinetic dumbbell from easily rolling away when dropped or set onto a floor.

Figure 3A:
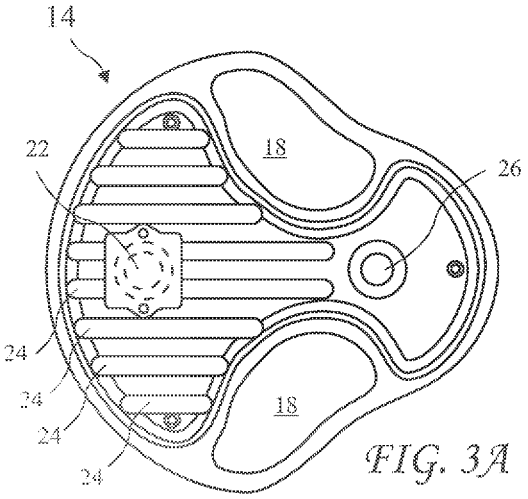
FIG. 3A is a detailed outside side view of a pear shaped offset weighted end of the kinetic dumbbell according to the present invention.
Figure 3B:
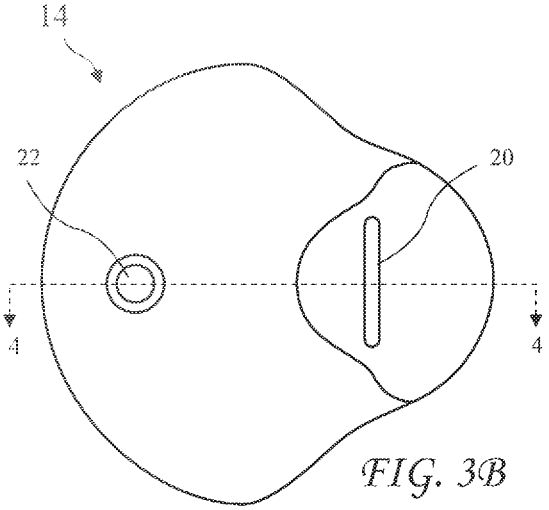
FIG. 3B is a detailed inside side view of a pear shaped offset weighted end of the kinetic dumbbell according to the present invention.
Figure 4:
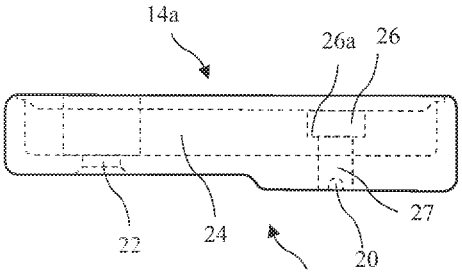
FIG. 4 is a cross-sectional view of the pear shaped offset weighted end of the kinetic dumbbell according to the present invention taken along line 4-4 of FIG. 3A.

A detailed outside side view of a pear shaped offset weighted end 14 of the kinetic dumbbell 10 is shown in FIG. 3A, a detailed inside side view of a pear shaped offset weighted end 14 is shown in FIG. 3B, and a cross-sectional view of the pear shaped offset weighted end 14, taken along line 4-4 of FIG. 3A, is shown in FIG. 4. The outside face 14*a* includes the recesses 18, the cavities 24, an optional timer recess 28, and an axle recess 26 and axle passage 27. The rear face 14*b* includes a channel 20 for an axle key 40 (see FIGS. 6A, 6B, and 7) which positions the pear shaped offset weighted end 14 with respect to the axle 34 and keeps the pear shaped offset weighted ends 14 from independently rotating and from rotating on the axle 34. The axle recess 26 includes a shoulder 26*a* for an axle washer 42 (see FIG. 6A).

Figure 5A:
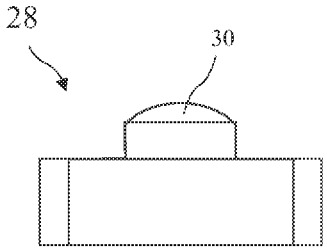
FIG. 5A is a side view of a timer attachable to the pear shaped offset weighted end of the kinetic dumbbell according to the present invention.
Figure 5B:
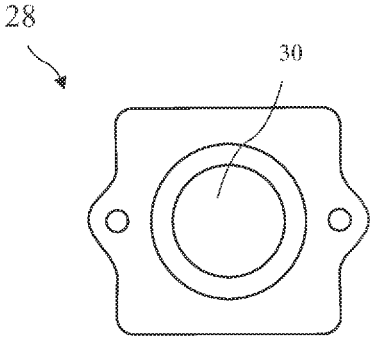
FIG. 5B is a top view of the timer attachable to the pear shaped offset weighted end of the kinetic dumbbell according to the present invention.

A side view of a timer 28 attachable to one of the pear shaped offset weighted ends 14 is shown in FIG. 5A and a top view of the timer 28 is shown in FIG. 5B. The timer 28 includes a button 30 for starting the timer and may have a single function or a selectable function, for example based on pressing the button more than once, or holding the button down. For example, the timer 28 may provide an audible signal after a period of time, or after sensing motion. The length of the period of time may be increased by pressing the button 30 multiple times, or by holding in the button.

Figure 6A:
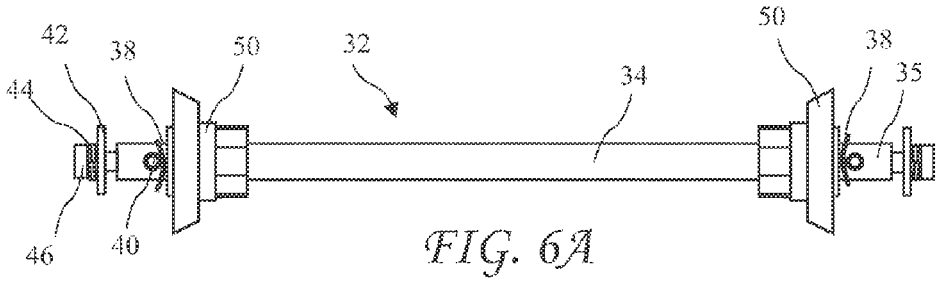
FIG. 6A is a side view of an axle assembly of the kinetic dumbbell according to the present invention.
Figure 6B:
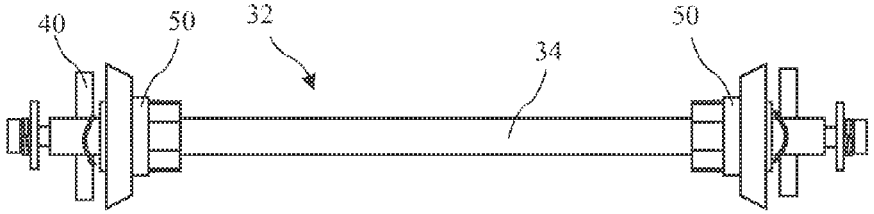
FIG. 6B is second a side view of the axle assembly of the kinetic dumbbell according to the present invention rolled 90 degrees.
Figure 7:
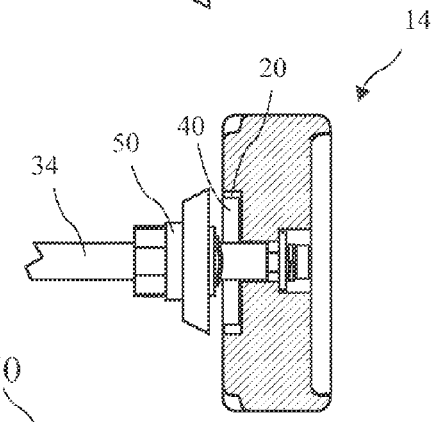
FIG. 7 show a cross-sectional view of an engagement of the one end of the axle assembly engaging one of the pear shaped offset weighted ends according to the present invention, taken along line 7-7 of FIG. 2B.

A side view of an axle assembly 32 of the kinetic dumbbell 10 is shown in FIG. 6A, a second a side view of the axle assembly 32 rolled 90 degrees is shown in FIG. 6B, and a cross-sectional view of an engagement of the one end of the axle assembly 32, engaging one of the pear shaped offset weighted ends 14, taken along line 7-7 of FIG. 2B is shown in FIG. 7. The axle assembly 32 includes an axle 34, and opposite ends 35 of the axle 34 passing through the inside face 14*b* of each weighted end 14, bushings 50, spring (or wave) washers 38, and keys 40, and against the outside face 14*a* of each weighted end 14, a flat washer 42, a lock washer 44 and a fastener 46. The bushing 50 is described in greater detail in FIGS. 8A-8C.

The spring washers 38 straddle the keys 40 and are compressed between the bushings 50 and the ends 14. The thickness of the spring washers may be selected to vary a resistance of the ends 14 to rotate on the handle 12. The combination of the weights 60 and the spring washers 38 allow the kinetic dumbbell 10 to be assembled to match a user's preferences.

The axle 34 is preferably a steel axle, about 0.43 inches in diameter, and 9.4 inches long, having female threads in opposite ends. The spring washers 38 reside between the bushing 50 and the weighted ends 14 increasing manufacturing tolerance and providing a snug fit of the handle 12 between the weighted ends 14. The keys 40 are preferably round pins and more preferably rolled pins press fit into holes through the axle 34. In one embodiment, the rolled pins are about 1.5 inches long and 0.2 inches in diameter.

The flat washers 42 are preferably about 0.75 inches in diameter and about 0.075 inches thick. The thickness being greater than a typical washer to provide additional strength. The lock washers 44 and fasteners 46 are preferably ¼ inch or M6 size.

Figure 8A:
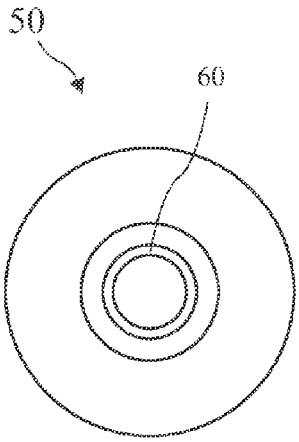
FIG. 8A is a rear view of a bushing of the axle assembly according to the present invention.
Figure 8B:
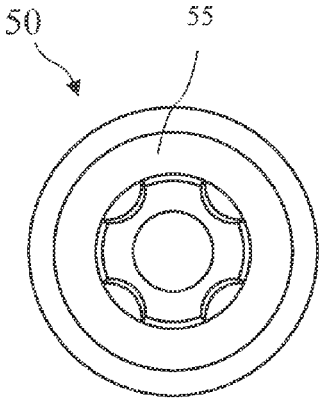
FIG. 8B is a front view of the bushing of the axle assembly according to the present invention.
Figure 8C:
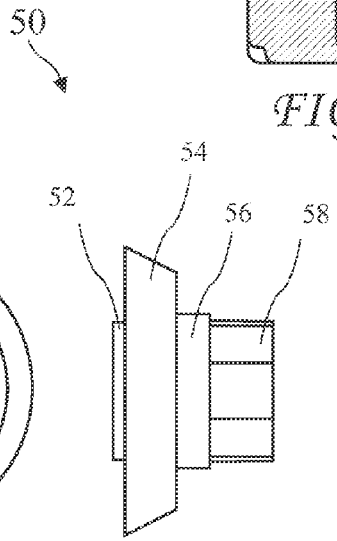
FIG. 8C is a side view of the bushing of the axle assembly according to the present invention.

A rear view of the bushing 50 is shown in FIG. 8A, a front view of the bushing 50 is shown in FIG. 8B, and a side view of the bushing 50 is shown in FIG. 8C. The bushing 50 is made from plastic and has an outward facing shoulder 52 facing the weighted ends 14, a tapered portion 54 facing the handle 12 and tapering from about 1.7 inches in diameter to about 1.4 inches in diameter away from the weighted ends 14 toward the handle 12. An inward facing shoulder 56 about 0.91 inches in diameter reaches into the handle 12 abutting against a metal liner 62 inside the handle 12 (see FIG. 10). A face 55 separates the tapered portion 54 from the shoulder 56 and abutts against a soft outer material 64 of the handle 12. A coarsely knurled tapered shoulder 58 extends inward from the shoulder 56, for example, having four axially extending rounded raised surfaces separated by four axially extending rounded indentations. The shoulder 58 is pressed into the metal liner 62 having an interference fit.

The weighted end 14 is sandwiched between the spring washer 38 and the flat washer 42, distributing the force against the weighted end 14. A cylindrical bushing 60 is press fit into the outside end of the bushing 50 and rides on the axle 34 providing easy rotation of the handle 12 on the axle 34, the bushing may be, for example, a bronze bushing.

Figure 9:
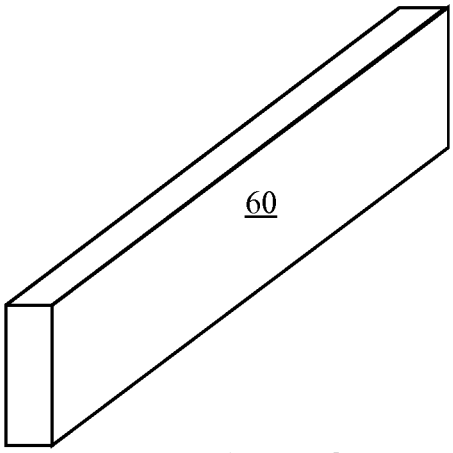
FIG. 9 shows a weight according to the present invention for use with the kinetic dumbbell.

A weight 60 for use with the kinetic dumbbell 10 is shown in FIG. 9. The weight 60 is made in various lengths and is an interference fit into the cavities 24 of the weighted end 14 (see FIG. 3A).

Figure 10:
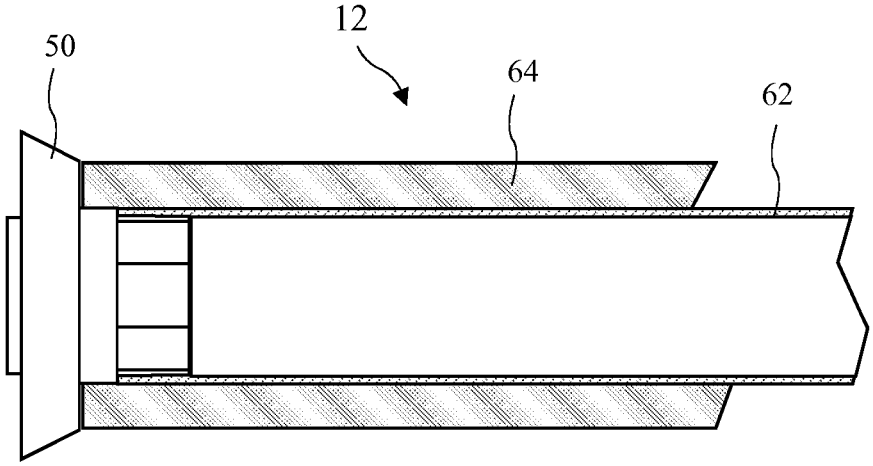
FIG. 10 shows a cross-sectional view of a handle of the kinetic dumbbell according to the present invention.

A cross-sectional view of the handle 12 of the kinetic dumbbell 10 is shown in FIG. 10. The metal liner 26 is pressed over the tapered shoulder 58 and the soft outer material 64 abuts against the face 55.

Figure 12:
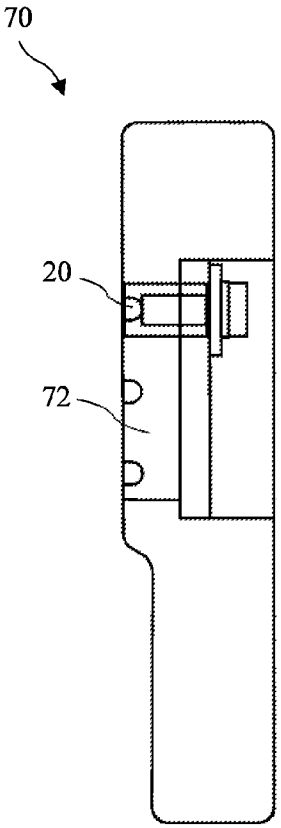
FIG. 12 shows a cross-sectional view of the adjustable weighted end of the kinetic dumbbell according to the present invention taken along line 12-12 of FIG. 11B.
Figure 11B:
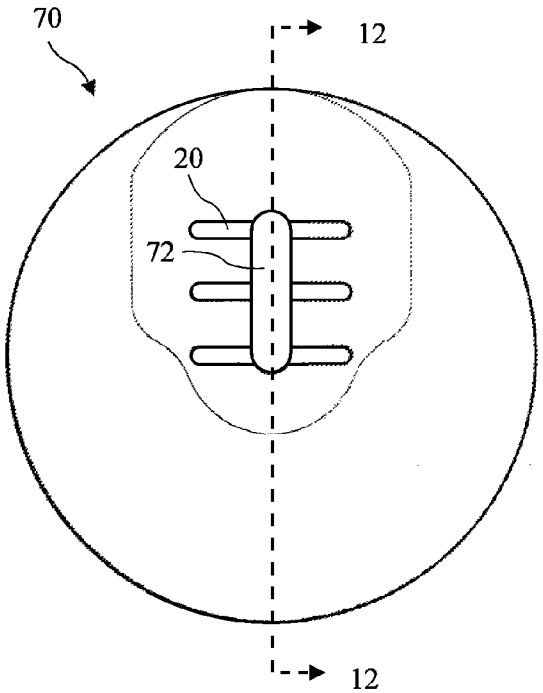
FIG. 11B shows a rear view of the adjustable weighted end of the kinetic dumbbell according to the present invention.
Figure 11A:
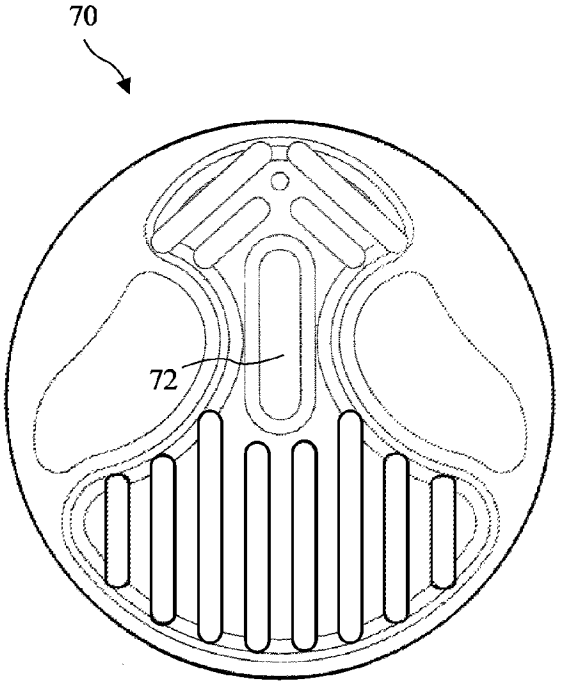
FIG. 11A shows a front view of an adjustable weighted end of the kinetic dumbbell according to the present invention.

A front view of an adjustable weighted end 70 of the kinetic dumbbell is shown in FIG. 11A, a rear view of the adjustable weighted end 70 is shown in FIG. 11B, and a cross-sectional view of the adjustable weighted end 70 taken along line 12-12 of FIG. 11B is shown in FIG. 12. The adjustable weighted end 70 includes a family of channels 20 and a slot 72 for an axle end 35 (see FIG. 6A). The channels 20 preferably include at least one offset channel for attaching the handle 12 to the adjustable weighted end 70 providing offset weights for use as a kinetic dumbbell, and at least one channel 20 providing centered weights for use as a standard dumbbell. Those skilled in the art will recognize that a handle may be attached to an adjustable end in various manners, both having discrete fixed locations as provided by the channels 20, and continuously adjustable locations, and any dumbbell allowing such adjustment is intended to come within the scope of the present invention.

While the invention herein disclosed has been described by means of specific embodiments and applications thereof, numerous modifications and variations could be made thereto by those skilled in the art without departing from the scope of the invention set forth in the claims.

I claim:

1. A kinetic dumbbell comprising:

a pair of pear shaped offset weighted ends;

cavities in the weighted ends configured to receive interference fit weights;

an axle attached to small ends of the pear shaped weighted ends;

rolled pins pressed though holes in the axle and residing in channels on interior faces of the weighted ends and aligning the weighted ends;

machine screws engaging female threads in ends of the axle attaching the weighted ends to the axle;

lock washers and flat washers residing between heads of the machine screws and ends of the axle;

a handle residing over the axle, the axle and weighted ends rotatable with respect to the handle;

bushings reside on the axle adjacent to the rolled pins, the handle is supported by the bushings; and spring washer reside on the axle between the rolled pins and the bushings and straddle the keys, the spring washer compressed between the bushings and the offset weighted ends providing resistance to rotation of the offset weighted ends on the handles.

2. The kinetic dumbbell of claim 1, wherein the flat washers 0.075 inches thick and about 0.75 inches in diameter.

3. A kinetic dumbbell comprising:

a pair of pear shaped offset weighted ends;

cavities in the weighted ends configured to receive interference fit weights;

an axle attached to small ends of the pear shaped weighted ends;

rolled pins pressed through holes in the axle and residing in channels on interior faces of the weighted ends and aligning the weighted ends;

machine screws engaging female threads in ends of the axle attaching the weighted ends to the axle;

lock washers and flat washers residing between heads of the machine screws and ends of the axle;

a handle residing over the axle, the axle and weighted ends rotatable with respect to the handle;

bushings reside on the axle adjacent to the rolled pins, the handle supported by the bushings;

spring washer residing on the axle between the rolled pins and the bushings.

4. The kinetic dumbbell of claim 3 further including a timer attached to one of the weighted ends to time a workout segment.

5. The kinetic dumbbell of claim 3, wherein the flat washers 0.075 inches thick and about one half inch in diameter.

6. A kinetic dumbbell comprising:

a pair of pear shaped offset weighted ends;

cavities in the weighted ends configured to receive interference fit weights;

an axle attached to small ends of the pear shaped weighted ends;

rolled pins pressed though holes in the axle and residing in channels on interior faces of the weighted ends and aligning the weighted ends;

machine screws engaging female threads in ends of the axle attaching the weighted ends to the axle;

lock washers and flat washers residing between heads of the machine screws and ends of the axle, the flat washers 0.075 inches thick and 0.75 inches in diameter;

a handle residing over the axle, the axle and weighted ends rotatable with respect to the handle;

bushings reside on the axle adjacent to the rolled pins, the handle is supported by the bushings; and spring washer reside on the axle between the keys and the bushings and straddle the keys, the spring washer compressed between the bushings and the offset weighted ends providing resistance to rotation of the offset weighted ends on the handles.

* * * * *